United States Patent [19]

Upton

[11] Patent Number: 4,502,500

[45] Date of Patent: Mar. 5, 1985

[54] WATER TRAPS

[76] Inventor: John Upton, 7 Rowgate, Upper Cumberworth, nr. Hudderesfield, West Yorkshire, England

[21] Appl. No.: 466,105

[22] Filed: Feb. 14, 1983

[51] Int. Cl.[3] ..... F16K 9/00

[52] U.S. Cl. ..... 137/247.25; 137/247.41

[58] Field of Search ..... 137/247.25, 247.41, 137/247.49

[56] References Cited

U.S. PATENT DOCUMENTS

| | | | |
|---|---|---|---|
| 424,943 | 4/1890 | Garrett | 137/247.25 |
| 767,904 | 8/1904 | Linke | 137/247.25 |
| 921,688 | 5/1909 | Fock | 137/247.25 |
| 1,027,997 | 5/1912 | Cudell | 137/247.25 |
| 1,375,598 | 4/1921 | Leonard | 137/247.25 X |

FOREIGN PATENT DOCUMENTS

| | | | |
|---|---|---|---|
| 59690 | 7/1947 | Netherlands | 137/247.25 |

*Primary Examiner*—Harold W. Weakley

*Attorney, Agent, or Firm*—W. Thad Adams, III

[57] ABSTRACT

A water trap comprises a body 10 which defines a passage having a downwardly extending portion 11 which in use communicates with the interior of a building and leads to a transverse portion 12 passing under a barrier 18. The transverse portion 12 leads in turn to an upwardly extension portion 13 which communicates through an outlet 14 with the exterior of the building. The transverse portion provides a gas barrier when filled with water. The trap includes at least one reservoir chamber 23, 24 which, when the trap is filled with water to the level of the outlet 14, contains sufficient water to refill the transverse portion 12 at least to the height of the barrier 18, should the transverse portion be emptied by siphonage.

4 Claims, 6 Drawing Figures

WATER TRAPS

BACKGROUND TO THE INVENTION

The invention relates to water traps, for example as used on waste water outlets from sinks, baths and the like. Such traps are designed to retain some water to provide a barrier to air passing back up the outlet, thus ensuring that the interior of a building is sealed off from unpleasant and/or harmful gases such as may enanate from drains and sewers.

DESCRIPTION OF THE PRIOR ART

Such traps generally comprise a body defining a passage which has a downwardly extending portion which in use communicates with the interior of a building, and leads to a transverse portion passing under some form of barrier, the transverse portion leading in turn to an upwardly extending portion which communicates with the exterior of the building.

After use, the transverse portion remains full of water at least up to a level of the barrier, thus forming a gas-tight seal.

Some known traps are of the so-called bottle type, in which a bottle-like chamber has a tube extending donwardly into the bottle. The tube defines the said downwardly extending portion, the bottom of the bottle defines the transverse portion, and the upwardly extending portion is defined between the interior upwardly extending walls of the bottle and the exterior upwardly extending walls of the tube.

Another known trap is of the so-called tubular type, in which the downwardly extending portion and the upwardly extending portion are defined by adjacent vertically extending tubes, so that in plan view the trap is larger in one direction than in another, whereas a bottle trap generally has a circular shape when viewed in plan.

Under some conditions severe siphonage can take place, causing the water in water traps to empty at least to a level which is below the said barrier, so that a gas-tight seal is no longer provided.

Various attempts have been made to overcome this siphonage problem. In some types of bottle trap and tubular trap it is possible to fit a valve into a wall of the outlet from the said upwardly extending portion, the valve being biased into a normally closed position, but being such that under severe siphonage conditions, suction causes the valve to open, admitting air and breaking the siphon before too much water has been emptied out of the trap. However such valves involve additional manufacturing and fitting, and may be prone to jamming unless regularly maintained.

One type of bottle trap is known in which a branch passage leads out of the said downwardly extending passage at a point above the said barrier, and into the outlet from the said upwardly extending portion. The said point where the branch passage leads out of the said downwardly extending portion is normally below the level of the water in the trap, so that a seal is still maintained, but if severe siphonage occurs, then as soon as the water level drops below the said point, the siphon is broken.

However in order to ensure that sufficient water will be retained to re-cover the said point when the water has fallen back after breaking of the siphon, it is necessary to make various portions of the passages of different cross-sectional areas, and this means that the trap cannot comply with all current British Standards, at least one of which requires a substantially constant cross-sectional area through the trap. Furthermore, breakage of the siphon in this manner causes a loud sucking noise in the building when breaking of the siphon occurs, which can be very irritating. The noise arises from suction taking place in a turbulent region which still contains a mixture of air and water.

OBJECT OF THE PRESENT INVENTION

I have now developed a water trap which can be manufactured either as a bottle trap or a tubular trap with integral anti-siphon properties involving no moving parts and which permits a constant cross-sectional area to be maintained throughout the trap. Furthermore, the trap is relatively quiet in operation, even under conditions of severed siphonage.

SUMMARY OF THE INVENTION

My invention provides a water trap comprising:

(a) a body;

(b) a passage defined by said body;

(c) a downwardly extending portion of said passage, which in use communicates with the interior of a building;

(d) a barrier;

(e) a transverse portion of said passage passing under said barrier and leading from said downwardly extending portion;

(f) an outlet to the exterior of the building;

(g) an upwardly extending portion of said passage leading from said transverse portion and communicating with said outlet;

(h) a gas barrier provided by said transverse portion when filled with water;

(i) at least one reservoir chamber which, when said trap is filled with water to the level of said outlet from said upwardly extending portion, contains sufficient water to refill said transverse portion at least to the height of said barrier, should said transverse portion be emptied by siphonage.

Preferably there are two reservoir chambers.

The or each reservoir chamber may, at its upper end, communicate with the outlet from the said upwardly extending portion via an opening which is large enough to permit the outward passage of air as the reservoir chamber is filled with water, but small enough to prevent siphonage suction from emptying the or each reservoir chamber.

Other objects, preferred features and advantages of the invention will become apparent from the following description of embodiments of the invention:

DESCRIPTION OF EMBODIMENTS OF THE INVENTION

Figure 1:
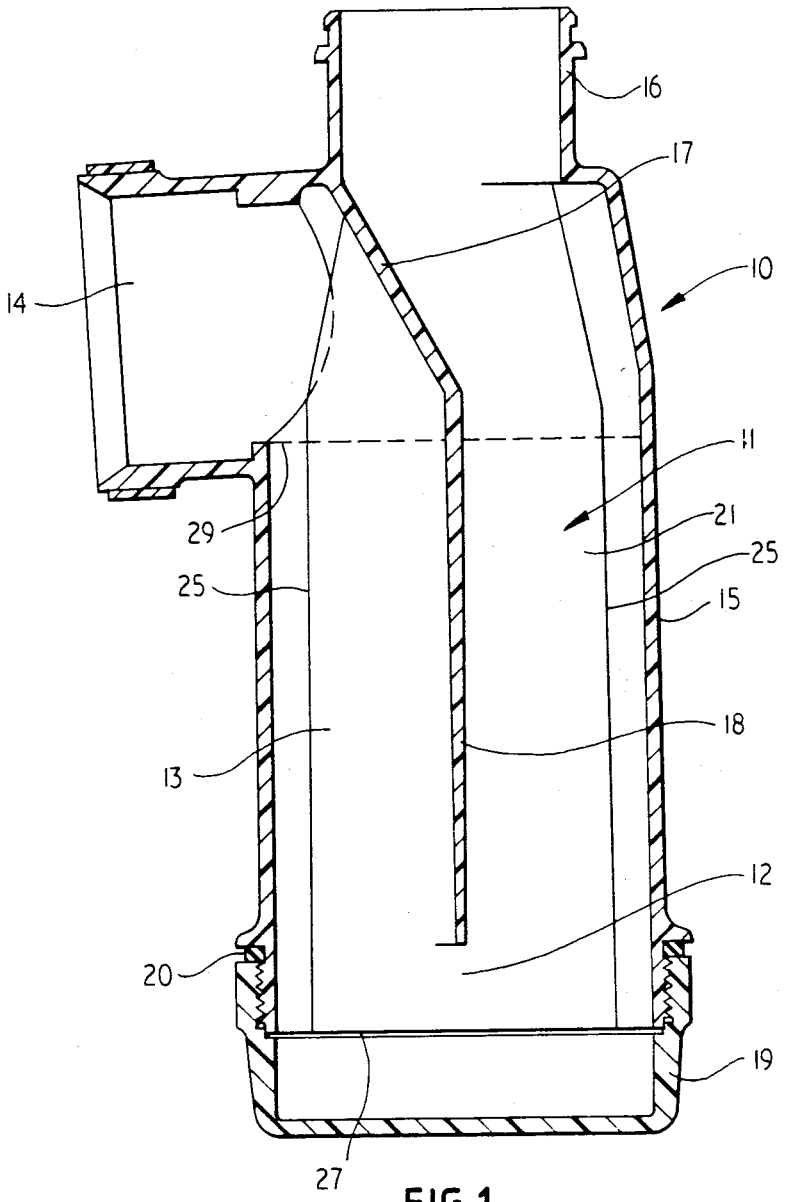
FIG. 1 is a vertical cross section through a bottle trap according to the invention.
Figure 2:
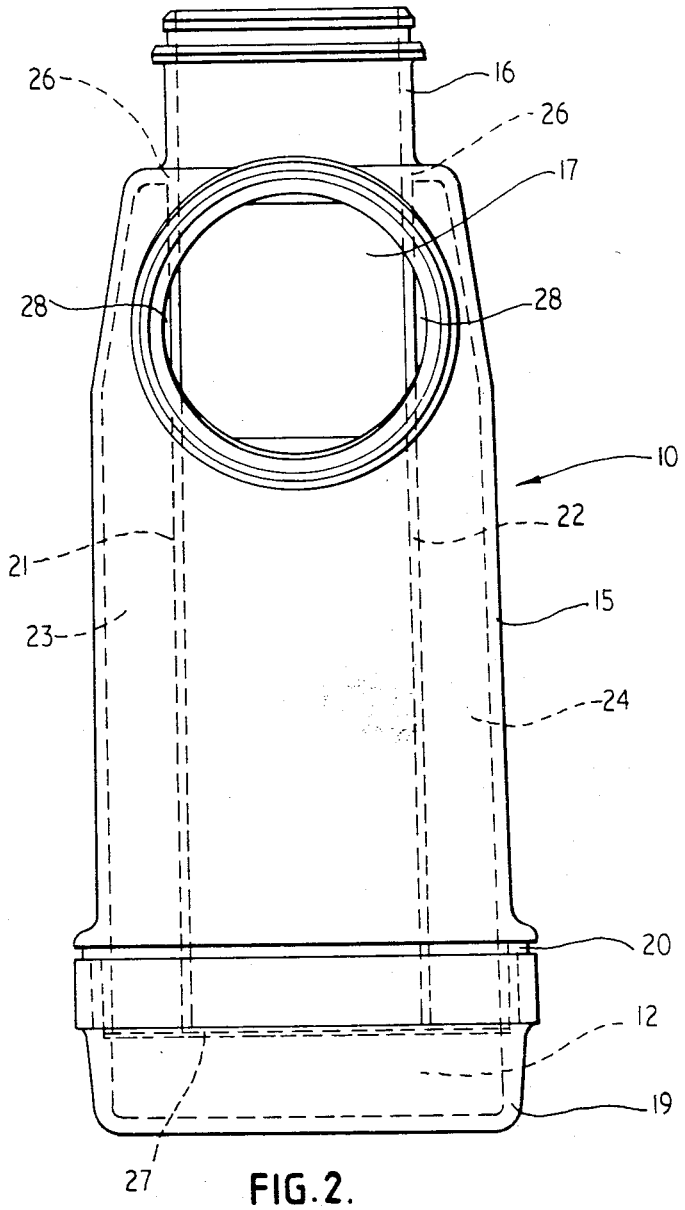
FIG. 2 is a view looking into the outlet from the upwardly extending portion of the passage of the bottle trap shown in FIG. 1.
Figure 3:
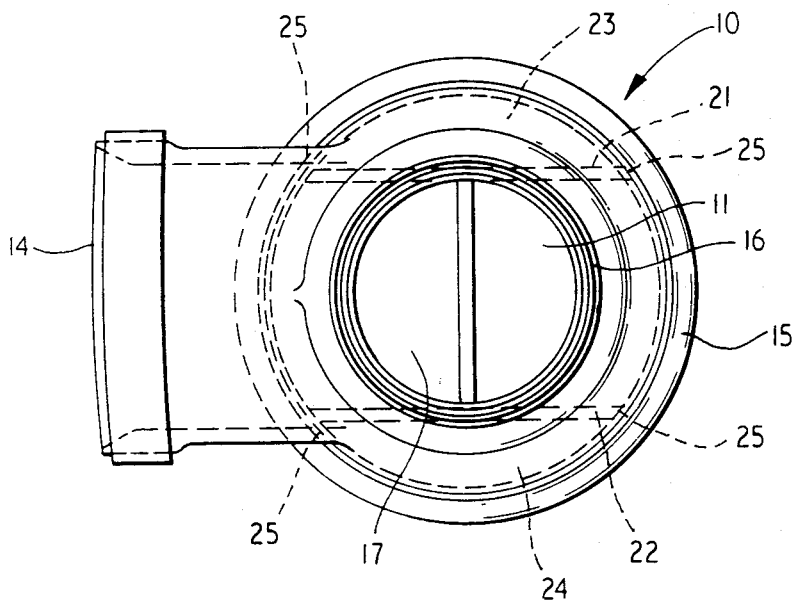
FIG. 3 is a plan view of the bottle trap shown in FIG. 1.

The trap shown in FIGS. 1 to 3 comprises a body 10 which defines a passage having a downwardly extending portion 11, a transverse portion 12, and an upwardly extending portion 13 which has an outlet 14.

The body 10 comprises a generally bottle-shaped portion 15 which has at its upper end a neck 16 by means of which the trap may be connected to a sink, bath or the like, so that when the trap is installed the passage portion 11 will communicate with the interior of the building.

The outlet 14 projects generally radially from the bottle-shaped body 15 and the two passage portions 11 and 13 are separated by a barrier member which has an upper inclined portion 17 and a lower vertical portion 18.

The transverse passage portion 12 passes underneath the barrier 18 and is defined by the bottom portion of the body 15, the very bottom 19 of the body 15 comprising a screw-threaded base which can be unscrewed and thus removed, for cleaning, but is normally screwed tightly into place, a rubber ring 20 providing a seal with the body.

Two parts of the interior of the body are blanked off by two parallel transverse walls 21 and 22 to define two reservoir chambers 23 and 24.

Each vertically extending edge of the walls 21 and 22 is integral with, and hence sealed to, the interior periphery of the body 15 at 25.

The upper edge of each of the walls 21 and 22 merges with, and is hence sealed to, the neck 16 of the bottle, at 26, (see FIG. 2).

Thus each reservoir chamber is open at only two points. Firstly, each reservoir chamber communicates with the passage portion 12 because the walls 21 and 22 stop short of the very bottom of the bottle, although as can be seen from FIGS. 1 and 2, they extend to a lower level than the barrier 18, and in fact terminate at 27.

Secondly, as can be seen from FIG. 2, the walls 21 and 22 are spaced apart by an amount which is slightly less than the diameter of the outlet 14, so that each reservoir chamber communicates with the outlet 14 through a very small opening 28.

When the trap is used in normal use, and waste water drains from a bath or sink through the trap and out to a drain attached to the outlet 14, the trap will, after use, remain full of water up to the level 29 shown in FIG. 1. There is thus a very effective seal and no unpleasant or harmful gases or odours can pass from the drain into the building through the trap.

The chambers 23 and 24 will of course also be full of water to the level 29. There is nothing to stop water rising up into the reservoir chambers when the trap is first used, since any air in the chambers can escape through the small openings 28.

Should conditions be such that severe siphoning takes place, the passage portions 11, 12 and 13 may be sucked clear of water until the water level drops below the bottom of the barrier 18, whereupon the siphon is broken. However the gas seal is immediately replaced because water then flows out of the reservoir chambers to make up any deficiency in the passage portion 12, and restore the water level in the passage portion 12 to a height which is above the bottom of the barrier 18. The next time that the trap is used normally under normal conditions, the trap, including the reservoir chambers, will again fill to capacity, ready to cope with the next odd occasion on which severe siphonage may occur.

Because the openings 28 are so small, there is virtually no tendency, during severe siphonage, for the reservoir chambers to empty by siphon action.

It will be seen that the anti-siphon properties of the trap shown in FIGS. 1 to 3 come about from the integral construction of the trap, without the need for any valves or moving parts.

Furthermore, it will be seen that the passage portions 11, 12 and 13 all have a substantially similar cross-section, the reservoir chambers effectively forming quite separate parts of the trap.

Furthermore, the trap is no noisier in operation, even when siphonage takes place, than any known traps which do not have anti-siphon properties. This is because the trap does not act by breaking the siphon earlier than normal. In the trap forming the subject of this embodiment siphonage breaks normally at the end of the siphoning action, as in a conventional trap. The anti-siphon properties arise owing to the fact that the trap is arranged to provide a reservoir of water to make up any deficiency after siphonage has taken place.

Figure 6:
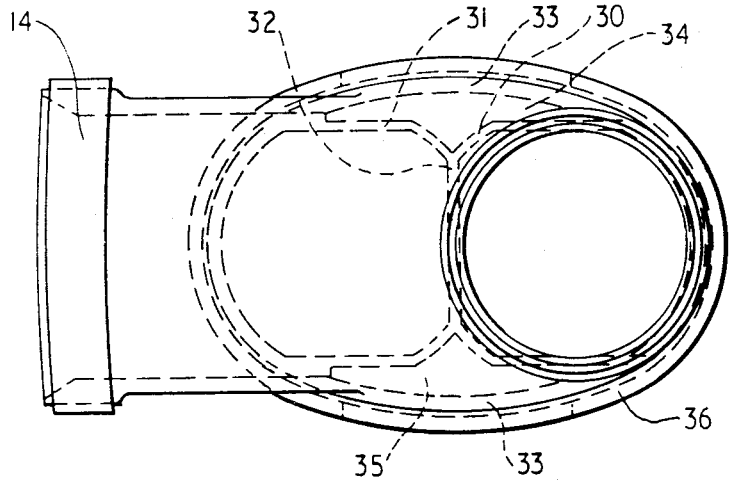
FIGS. 4, 5 and 6 are views corresponding to FIGS. 1, 2 and 3, but showing a tubular trap according to the invention.
Figure 4:
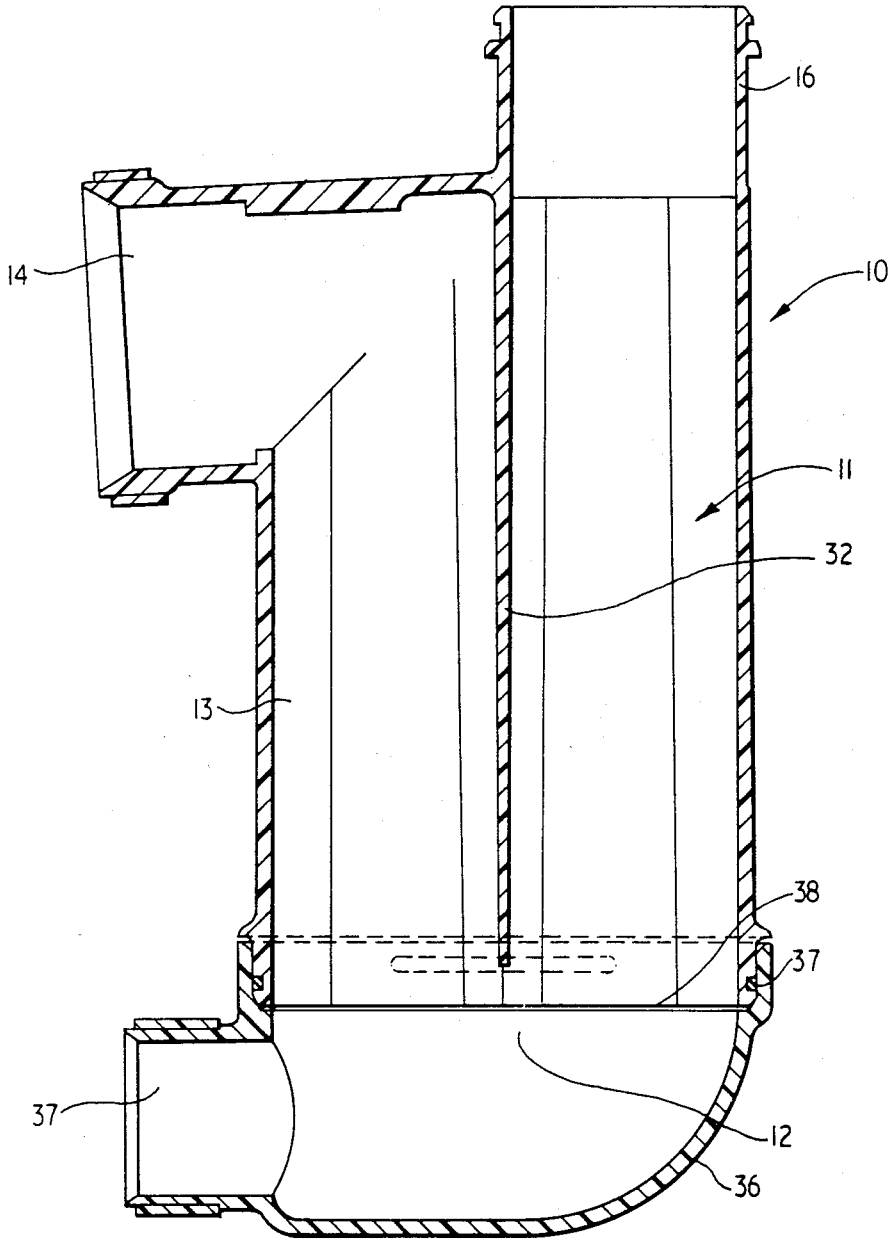
Figure 5:
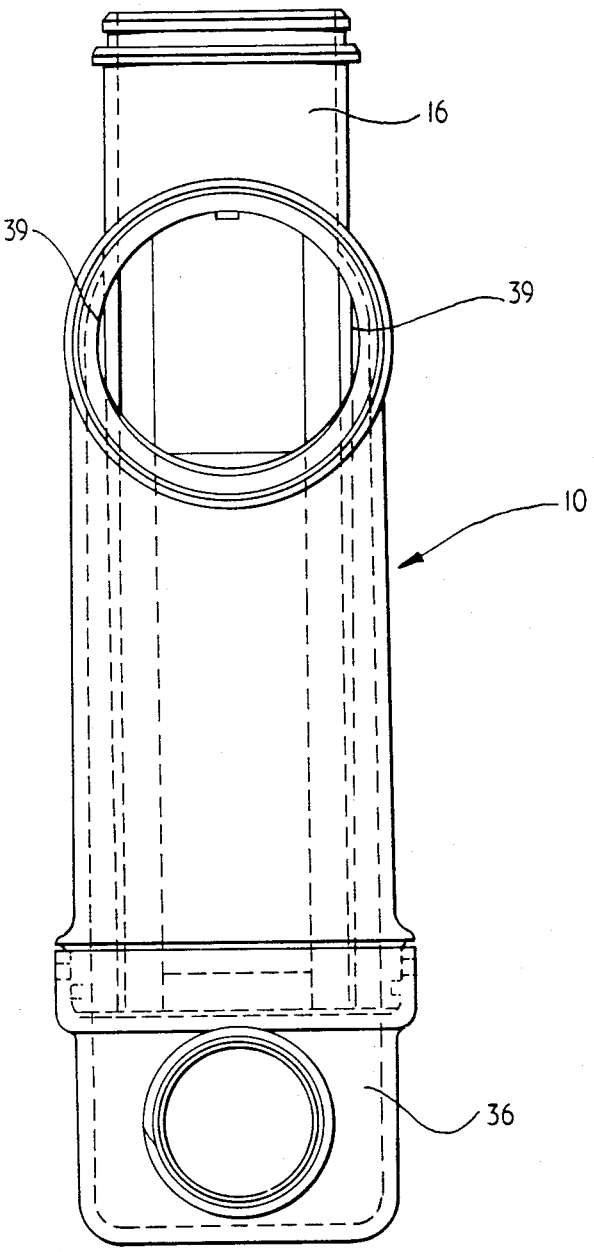

The tubular trap shown in FIGS. 4 to 6 also has a body 10 defining passage portions 11, 12, and 13, upwardly extending passage portion 13 leading to an outlet 14.

However passage portions 11 and 13 can be thought of as being defined by separate parallel tubes 30 and 31, as best seen in FIG. 6, although in fact the tubes are integrally formed and have a common wall 32 providing a barrier which has a similar function to the barrier 18 of FIG. 1.

The neck 16 of the trap is merely a continuation of the tube 30.

Where the tubes join together, the trap has an outer skin 33 (see FIG. 6) at each side, giving the trap a generally oval cross-section when seen in plan and defining with the junction between the tubes two reservoir chambers 34 and 35.

The transverse passage portion 12 is defined in part by a generally oval base member 36 which snap-fits on to the bottom of the trap, a sealing ring 37 being provided. A normally closed outlet 37 is provided from the portion 36, for example for rodding or cleaning purposes.

The reservoir chambers 34 and 35 operate in an identical manner to the chambers 23 and 24, as they terminate at the point 38 shown in FIG. 4, below the level of the barrier 32, and they also communicate with the outlet 14 through small openings 39, as shown in FIG. 5.

The invention is not restricted to the details of the foregoing embodiments.

I claim:

1. A water trap comprising:

(a) a body;

(b) a passage defined by said body;

(c) a downwardly extending portion of said passage, which in use communicates with the interior of a building;

(d) a barrier;

(e) a transverse portion of said passage passing under said barrier and leading from said downwardly extending portion;

(f) an outlet to the exterior of the building;

(g) an upwardly extending portion of said passage leading from said transverse portion and communicating with said outlet;

(h) a gas barrier provided by said transverse portion when filled with water;

(i) at least one reservoir chamber which, when said trap is filled with water to the level of said outlet from said upwardly extending portion, contains sufficient water to refill said transverse portion at least to the height of said barrier, should said transverse portion be emptied by siphonage, the reservoir chamber, when viewed in plan, being offset to one side of a notional line joining the inlet and the outlet to provide a compact construction having an efficient anti-siphoning action.

2. A water trap as claimed in claim 1, in which there are two reservoir chambers, one on each side of said notional line.

3. A water trap as claimed in claim 1, in which the or each reservoir chamber, at its upper end, communicates with the outlet from the said upwardly extending portion via an opening which is large enough to permit the outward passage of air as the reservoir chamber is filled with water, but small enough to prevent siphonage suction from emptying the or each reservoir chamber.

4. A water trap as claimed in claim 2, in which the or each reservoir chamber, at its upper end, communicates with the outlet from the said upwardly extending portion via an opening which is large enough to permit the outward passage of air as the reservoir chamber is filled with water, but small enough to prevent siphonage suction from emptying the or each reservoir chamber.

* * * * *